United States Patent [19]

Cook

[11] 4,422,808

[45] Dec. 27, 1983

[54] HYDRAULICALLY-OPERATED DEVICES

[75] Inventor: Stephen P. Cook, Walton, England

[73] Assignee: Dowty Mining Equipment Limited, United Kingdom

[21] Appl. No.: 395,973

[22] Filed: Jul. 7, 1982

[30] Foreign Application Priority Data

Jul. 16, 1981 [GB] United Kingdom ..... 8121999

[51] Int. Cl.[3] ..... E21D 23/16

[52] U.S. Cl. ..... 405/302; 91/170 MP

[58] Field of Search ..... 405/302; 91/170 MP, 91/512, 517, 518

[56] References Cited

U.S. PATENT DOCUMENTS

| | | | |
|---|---|---|---|
| 3,202,058 | 8/1965 | Bolton et al. | 405/302 |
| 3,216,201 | 11/1965 | Kibble et al. | 405/302 |
| 3,228,199 | 1/1966 | Potts et al. | 405/302 |
| 3,243,964 | 4/1966 | Thomas et al. | 405/302 |
| 3,246,576 | 4/1966 | Kibble et al. | 405/302 |
| 3,272,084 | 9/1966 | Bolton et al. | 91/512 |
| 3,320,001 | 5/1967 | Allen et al. | 405/302 |
| 3,405,608 | 10/1968 | Teale | 405/302 |
| 3,589,241 | 6/1971 | Bolton | 405/302 |
| 4,109,472 | 8/1978 | Harris | 405/302 |
| 4,159,671 | 7/1979 | Allen | 405/302 |

FOREIGN PATENT DOCUMENTS

| | | | |
|---|---|---|---|
| 1114006 | 5/1968 | United Kingdom | 91/170 MP |

*Primary Examiner*—Dennis L. Taylor
*Assistant Examiner*—John A. Gungor
*Attorney, Agent, or Firm*—Hayes, Davis & Soloway

[57] ABSTRACT

An assembly of mine roof supports each of which has a control member and a hydraulically-operated member, e.g. a cantilever. The cantilevers operate one after the other in a predetermined sequence in response to actuation of one of the control members.

Each cantilever is associated with a pressure-operated control valve and two serially-connected control valves which normally prevent operation of a cantilever in response to actuation of a control member unless the next-before cantilever in the series has completed its operation and the control member which caused that next-before cantilever to operate has been actuated.

3 Claims, 2 Drawing Figures

HYDRAULICALLY-OPERATED DEVICES

Figure 1:
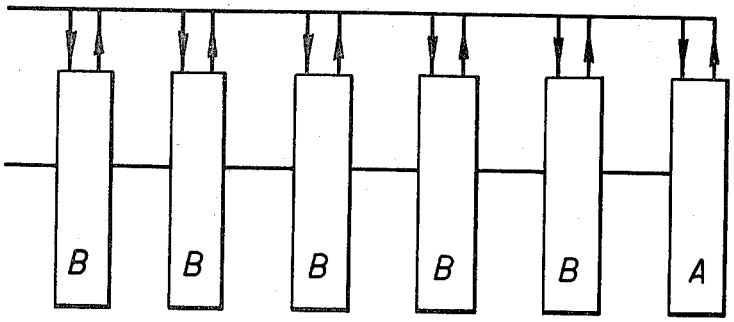

This invention relates to an assembly of mine-roof supports each of which has hydraulically-operated means, which means have to be operated, one after the other, in a predetermined sequence.

The background to the invention and an exemplary embodiment of the invention will be described with reference to that hydraulically-operated means of a mine-roof support which is a cantilever and which, in use, has to be extended with respect to the roof-engaging member or canopy of the mine-roof support. The invention is not, however, limited to such hydraulically-operated means as cantilevers.

Mine-roof supports are ranged along a coal face, one beside the other, to form an assembly of such supports. They support the roof extending from one end of the coal face to the other end of the coal face. Coal is removed from a coal face by a cutting machine which moves from one end of the coal face to the other end. The newly-exposed roof of the mine, due to the cutting of the coal face, requires to be supported as soon as possible and, to that end, each support has a cantilever carried by the roof-engaging member or canopy. The cantilever of a support is extended from an inoperative (that is to say, a non-roof-supporting) position, to support the newly-exposed roof as soon as the cutting machine has passed the support.

To effect extension of a cantilever, a miner who is sheltering under a mine-roof support near to the cutting machine, will actuate a control member on that support. Actuation of that control member causes the cantilever of another support to extend, provided that the cantilever of the next before support in the sequence has completed its extension. When it has completed its extension, if the miner keeps the control member in an actuated condition, the next cantilever in the sequence will be caused to be extended. Permitting a number of cantilevers to be extended one after the other by keeping the control member actuated is not desirable because one of those cantilevers could hit, or be hit by, the moving coal cutting machine. Consequently, the miner who has actuated a control member must de-actuate it immediately after the desired cantilever has advanced, and this is not always easy.

It is an object of the invention to provide an improved assembly of mine-roof supports.

The invention provides an assembly of mine-roof supports of which:

(i) each has hydraulically-operated means, the assembly of hydraulically-operated means, in use, being operated one after the other in a predetermined sequence, (ii) each of some at least has a control member actuable to cause operation of the hydraulically-operated means of other mine-roof supports, and (iii) each, other than that having the first hydraulically-operated means to be operated in the predetermined sequence, has associated with it hydraulic control means (a) normally to prevent operation of a hydraulically-operated means in response to actuation of a control member, but (b) operable, in response both to the completion of operation of the next-before hydraulically-operated means in the sequence and to the de-actuation of the control member which caused operation of that next-before means, to permit operation of the next-to-operate hydraulically-operated means in the sequence when a control member is next actuated.

The hydraulic control means associated with a mine-roof support may be on the support whose cantilever it controls, or may be on another support.

Each control member may be a manually-operable hydraulic control valve which, when actuated, permits liquid under pressure to pass to a number of hydraulically-operated means to cause operation of one of those hydraulically-operated means provided that the hydraulic control means permits it to operate.

Each hydraulic control means may comprise a pressure-operated hydraulic control valve, and two further pressure-operated hydraulic control valves connected in series. One of the further pressure-operated valves is arranged so that it will only permit the flow of liquid under pressure through it when the hydraulically-operated means next before in the predetermined sequence has completed its operation. The other of the further pressure-operated valves is arranged so that it will only permit the flow of liquid under pressure through it when the control member which caused that next-before-means to operate has been de-actuated. Flow of liquid under pressure through the serially-connected valves will cause operation of the first-mentioned hydraulic control valve. When that valve has operated, liquid under pressure from the control member is passed to the hydraulically-operated means to cause it to operate. The hydraulically-operated means may be arranged in groups or batches, each group or batch comprising a plurality of such means. In that case, one at least of the hydraulically-operated means in a group or batch will have a control member, and each control member will be connected with each of the hydraulically-operated means in a chosen one of the other groups or batches, but to no other groups or batches.

Figure 2:
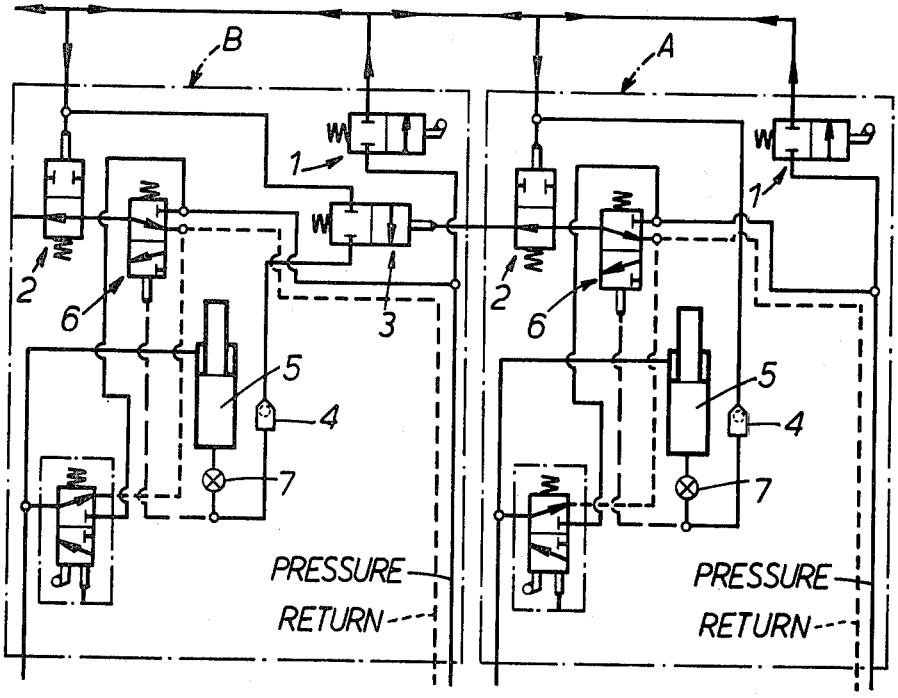

An assembly of mine-roof supports with hydraulically-operated cantilevers is shown schematically in FIG. 1 of the accompanying drawings. FIG. 2 shows the relevant hydraulic circuits for the cantilevers of two mine-roof supports of that assembly.

The hydraulic circuits associated with the mine-roof supports B are the same; that of mine-roof support A, which has the first cantilever to be operated in the predetermined sequence, is slightly different.

As shown in FIG. 2, each hydraulic circuit has a manually-operable hydraulic control valve, herein called an "initiate-send" valve, 1, which is manually-operable from the position shown in the drawing to one in which liquid at high pressure is connected to the initiate-send valve 1 of each of the other units of the assembly, to a pressure-operated hydraulic control valve, herein called a first priming valve, 2, and to a pressure-operated hydraulic control valve, herein called a second priming valve, 3, of each unit B. Unit A does not have such a second priming valve 3, and the liquid under pressure is fed by way of a check valve 4 to a hydraulic jack 5 for operating the cantilever of the unit. Each unit B also has a check valve 4 and a hydraulic jack 5.

In order to start the predetermined sequence of operation, during which the cantilevers of the units will be extended one after the other, the initiate-send valve 1 of any appropriate unit is actuated and liquid under pressure flows through the check valve of Unit A to energise the jack 5 of Unit A. The liquid under pressure cannot actuate any jack 5 of any other unit B, because the second priming valve 3 of each such unit is in the position shown in the drawings and the liquid cannot flow through it.

When the cantilever of unit A has completed its operation pressure builds up and causes actuation of a pressure-operated hydraulic control valve, herein called a third priming valve, 6, moving it from the position shown in the drawings to a position in which liquid under high pressure passes through the valve 6 to the first priming valve 2. So long as the initiate-send valve, which caused operation of the centilever of unit A, remains actuated, the first priming valve 2, due to it having moved from the position shown in the drawings due to pressure from the initiate-send valve, will not permit liquid under pressure, derived from the third priming valve 6 to actuate the second priming valve 3 of the unit B next to operate in the sequence. The sequence of operation thus stops.

In order to restart the sequence of operation, it is necessary for the operator to de-actuate the initiate-send valve 1 which he had previously actuated and then to re-actuate it or to actuate any other appropriate initiate-send valve. Upon de-actuation, the first priming valve 2 moves back to the position shown in the drawings, and liquid at high pressure then flows from the third priming valve 6 of unit A to the second priming valve 3 of the unit B next to operate in the sequence. That second priming valve 3 moves from the position shown in the drawings to one in which liquid under pressure from the re-actuated initiate-send valve, or another actuated initiate-send valve, can flow by way of the check valve 4 of that unit B to the jack 5 of that unit B.

Thus the sequence of operations can only continue if two things have happened; first, the next-before cantilever in the sequence of operations has operated and actuated the third priming valve and second, the initiate-send valve which caused operation of that cantilever has been de-actuated to cause de-actuation of the first priming valve.

The operation just described can be over-ridden, if required, by a manually-operable valve (not shown) on each unit which controls the operation of the jack in that unit. This valve can also permit flow of liquid from the jack when the cantilever is being retracted.

If desired, a stop valve 7 may be included between the jack 5 and its connection to the line between the check valve 4 and the third priming valve 6. When the valve is closed the jack 5 is isolated but the pressure is applied as described above to the third priming valve 6 to render the jack of the next support operable.

I claim:

1. An assembly of mine-roof supports in which (i) each mine-roof support has hydraulically-operated means, the assembly of hydraulically-operated means, in use, being operated one after the other in a predetermined sequence, (ii) each of some at least of the mine-roof supports has a manually-actuable control member connected to each of a plurality of other mine-roof supports in the sequence to send, when actuated, a signal to initiate operation of each of the hydraulically-operated means of said plurality of other mine-roof supports and to maintain that signal so long as the control member is actuated, and (iii) each mine-roof support, other than that having the first hydraulically-operated means to be operated in the predetermined sequence, has associated with it hydraulic control means (a) normally to prevent operation of a hydraulically-operated means in response to a signal sent from an actuated control member, but (b) operable, in response both to the completion of operation of the next-before hydraulically-operated means in the sequence and to the de-actuation of a control member which, as a consequence of its actuation, caused operation of that next-before hydraulically-operated means in the sequence, to permit operation of the next-to-operate hydraulically-operated means in the sequence when a control member is next actuated, to send a signal to that next-to-operate hydraulically-operated means.

2. An assembly of mine-roof supports as claimed in claim 1 wherein each hydraulic control means comprises a first pressure-operated hydraulic control valve and two further serially-connected pressure-operated hydraulic control valves, one of the two being responsive to the completion of operation of the next-before hydraulic means in the sequence to permit the flow of fluid to the second of the two, and the second being responsive to the de-actuation of the control member which caused operation of the next-before hydraulic means in the sequence to permit the flow of said fluid to the first pressure-operated hydraulic control valve.

3. An assembly of mine-roof supports of which (i) each has hydraulically-operated means, the assembly of hydraulically-operated means, in use, being operated one after the other in a predetermined sequence, (ii) each of some at least has a control member actuable to cause operation of the hydraulically-operated means of other mine-roof supports, and (iii) each, other than that having the first hydraulically-operated means to be operated in the predetermined sequence, has associated with it hydraulic control means (a) normally to prevent operation of a hydraulically-operated means in response to actuation of a control member, but (b) operable, in response both to the completion of operation of the next-before hydraulically-operated means in sequence and to the de-actuation of the control member which caused operation of that next-before means, to permit operation of the next-to-operate hydraulically-operated means in the sequence when a control member is next actuated, and (c) comprising a first pressure-operated hydraulic control valve and two further serially-connected pressure-operated hydraulic control valves, one of the two being responsive to the completion of operation of the next-before hydraulic means in the sequence to permit the flow of fluid to the second of the two, and the second being responsive to the deactuation of the control member which caused operation of the next-before hydraulic means in the sequence to permit the flow of said fluid to the first pressure-operated hydraulic control valve.

* * * * *